US007477133B2

(12) United States Patent
Abdulkader

(10) Patent No.: US 7,477,133 B2
(45) Date of Patent: Jan. 13, 2009

(54) STARTING GATE AND TIMING DEVICE

(76) Inventor: Jafar Abdulla Abdulkader, P.O. Box 29833, Safat, 13158 (KW)

( * ) Notice: Subject to any disclaimer, the term of this patent is extended or adjusted under 35 U.S.C. 154(b) by 888 days.

(21) Appl. No.: 10/896,973

(22) Filed: Jul. 23, 2004

(65) Prior Publication Data

US 2006/0017230 A1 Jan. 26, 2006

(51) Int. Cl.
*G08B 23/00* (2006.01)

(52) U.S. Cl. ..... 340/323 R; 119/423; 273/445

(58) Field of Classification Search ..... 340/323 R; 119/423–426; 273/445; 473/85–87
See application file for complete search history.

(56) References Cited

U.S. PATENT DOCUMENTS 2,165,937 A 7/1939 Nancarrow
2,319,420 A * 5/1943 Macksoud ..... 119/426
3,951,403 A 4/1976 Kirkham
4,134,230 A * 1/1979 Roy ..... 49/49
4,156,870 A 5/1979 Desarzens
4,780,085 A 10/1988 Malone
4,890,827 A 1/1990 Tottey

FOREIGN PATENT DOCUMENTS

FR 625.982 8/1927
FR 774.213 12/1934
FR 1.435.110 3/1966

* cited by examiner

*Primary Examiner*—Brent Swarthout
(74) *Attorney, Agent, or Firm*—Lowe Hauptman Ham & Berner, LLP

(57) ABSTRACT

A starting gate and timing device for foot races includes a frame and a plurality of levered restraints disposed across a track. Each of the levered restraints includes a barrier portion which is adapted to prevent a runner from crossing the start line before the barrier is moved out of the way. Each of the barrier portions also includes an audio speaker for alerting a runner of the start of a race. A scoreboard, timer and sensor are also provided for timing the race. A control system for controlling a start of a race is provided.

8 Claims, 5 Drawing Sheets

STARTING GATE AND TIMING DEVICE

FIELD OF THE INVENTION

This invention relates to a starting gate for preventing false starts in an athletic event such as a foot race and more particularly to a starting gate and timing device which prevents false starts and times the event.

BACKGROUND FOR THE INVENTION

Starting devices for horse races, automotive races, motorcycle races, dog races and the like are well-known. However, such devices have not been generally accepted for track and field events. Nevertheless, it is presently believed that there may be a demand for an improved starting gate and timing device for track events, speed skating and the like.

It is believed that there may be a commercial market for a starting gate and timing device according to the present invention for several reasons. For example, the starting gate and timing devices as disclosed herein will essentially eliminate false starts, and at the same time ensure each participant of an even start of an event. To be more specific, the starting gate and timing devices can be programmed to provide voice commands with consistent cadence and will allow participants to preview the cadence before an event.

In addition, the starting gate and timing device disclosed herein allows a participant to concentrate on the start as opposed to watching for a puff of smoke from a starting pistol. Further the device as disclosed herein will eliminate disputes over the start of an event and provide accurate timing of one or more athletes in events where thousands of a second may be the difference between the winner and runner-up.

It is also contemplated that the starting gate and timing device in accordance with the present invention may be used to provide a handicap system where the end of a race will provide a more exciting finish for the spectators.

It is further believed that the starting gate and timing devices in accordance with the present invention can be manufactured in a portable and readily transportable form, at a reasonable cost and in a durable form.

BRIEF SUMMARY OF THE INVENTION

In essence, the present invention contemplates a starting gate for preventing false starts during an athletic event such as a foot race. The starting gate is primarily designed for the start of races in a track and field event, but may find applications as for example, swimming, speed skating, other athletic endeavors and as a training device for athletes that pursue such endeavors. The starting gate comprises a levered restraint or barrier and an audio speaker disposed on or in close proximity to the barrier. The starting gate also includes means for positioning the barrier in front of an athlete with the audio speaker adjacent to an ear of the athlete. Means are also provided for moving the restraint out of the way of the athlete at the start of the event or race.

A preferred embodiment of the invention includes a starting gate and timing device for use at an athletic event such as a foot race between a starting area and a finish line. The starting gate includes a frame i.e., a horizontal bar and two vertical supports which position the horizontal bar above and across a track. A plurality of levered restraints each of which includes a first or fixed portion is fixed to and rotatable about the horizontal bar. The plurality of levered restraints each include a second or barrier portion for positioning in front of an athlete. In the preferred embodiment of the invention, means are provided for adjusting the height of the barrier portion to position the barrier portion in front of the athlete's face. A plurality of audio speakers with at least one speaker and preferably two speakers are disposed on each of the barrier portions and adjacent to an ear or ears of an athlete. Means such as a sensor actuating mechanism for simultaneously moving each of the barrier portions out of the way of the athlete or runner at the start of a race is also provided. In addition, a timer and means for starting the timer are operatively connected to the barrier portion or means for simultaneously moving each of the barrier portions to start the times at the beginning of an event. The device also includes a sensor such as a light beam or tape disposed at the finish line which is connected to the timer for stopping the timer when an athlete crosses the finish line to thereby record the time of the event.

The invention will now be described in connection with the following figures wherein like numerals have been used to designate like parts.

DETAILED DESCRIPTION OF THE PREFERRED EMBODIMENT OF THE INVENTION

Figure 1:
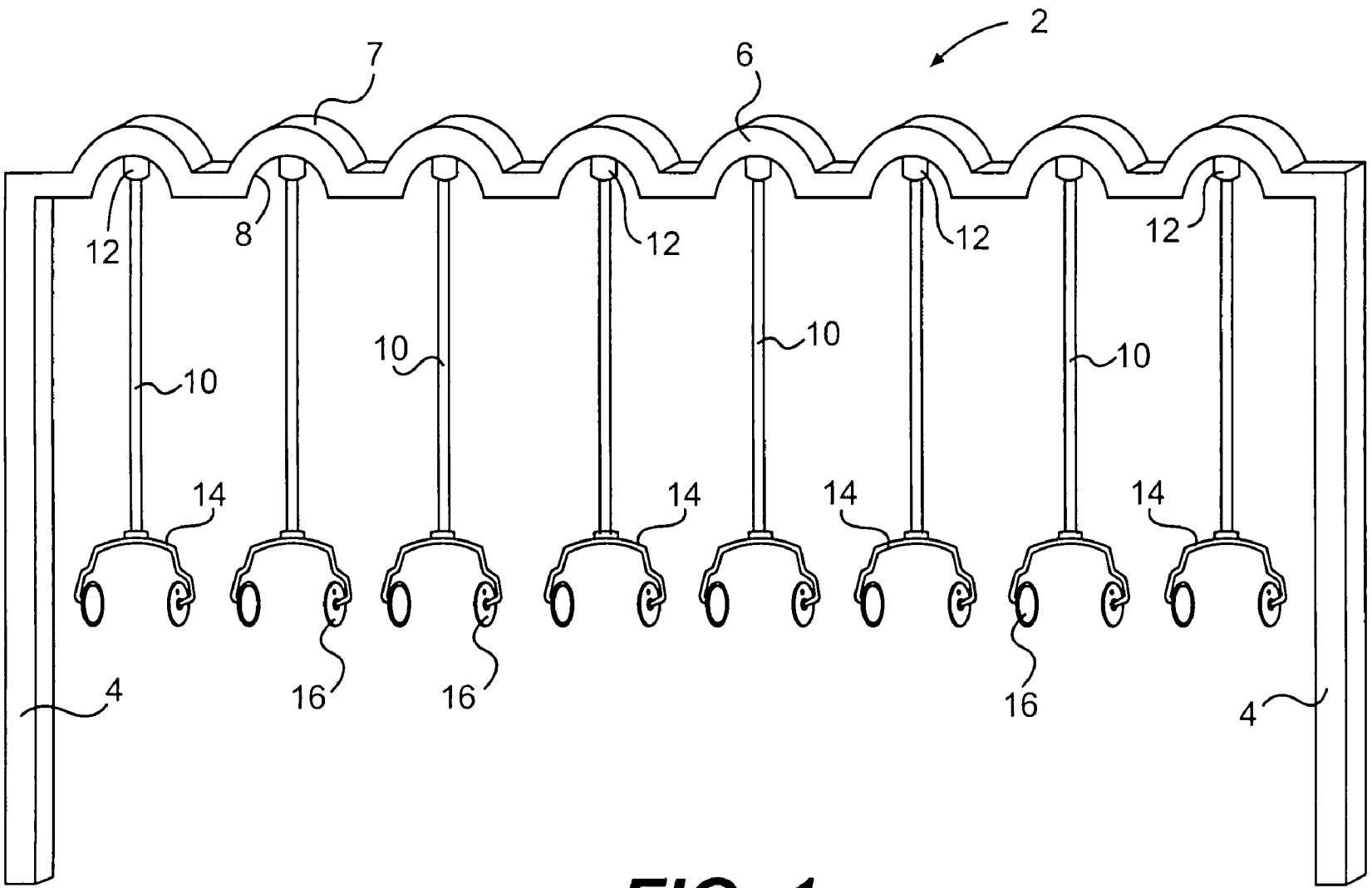
FIG. 1 is a schematic illustration of a starting gate in accordance with the invention.

FIG. 1 illustrates a starting gate structure 2 which includes a pair of vertical supports 4 and a horizontal support member or bar 6. The horizontal support member or bar 6 is fixed to the top of the vertical supports 4 and positioned above and across a starting area for an athletic event as for example the start line for a foot race. As illustrated, the horizontal support member or bar 6 may include a plurality of convex and concave portions 7 and 8, respectively, which corresponds to the lanes in a track.

A plurality of levered restraints 10 each of which includes a first or fixed portion 12 are fixed to but rotatable about the horizontal support member or bar 6 in a conventional manner. The levered restraints are fixed to the support member 6 and if they are prevented from movement along the support member 6. Nevertheless, the restraints 10 are free to move upwardly in an arc a sufficient distance to allow a runner to pass under the levered restraint 10. The levered restraint 10 also includes a second or barrier portion 14. The barrier portions 14 are at the opposite ends of the levered restraints 10 from the fixed portions 12 and are adapted to be positioned in front of a runner's head or face. Each of the barrier portions 14 also carry at least one and preferably a pair of audio speakers 16 which are positioned adjacent to the ears of an athlete or runner. Further details of the levered restraint and mechanism for moving the levered restraints will be described in connection with FIGS. 5 and 6.

Figure 2:
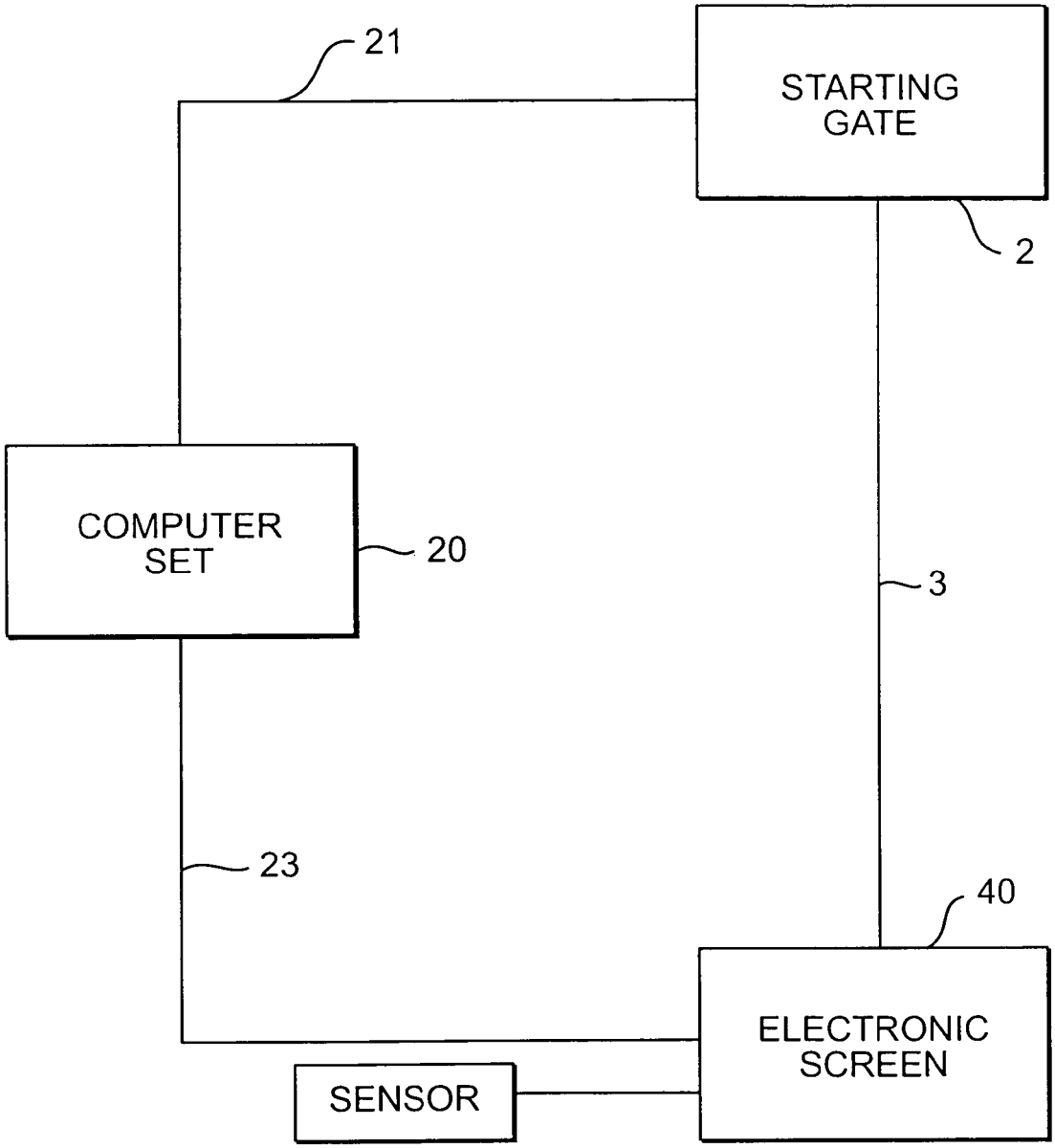
FIG. 2 is a block diagram illustrating a starting gate and timing device in accordance with the present invention.

FIG. 2 is a block diagram which illustrates the basic concepts of the starting gate and timing device in accordance with the present invention. As shown therein, the starting gate 2 is operatively connected to a computer set or control system 20 and an electronic scoreboard 40 by conventional wires or by a wireless connection. The electronic screen 40 may also be but is not necessarily directly linked to the starting gate 2 by a wire 3 or wireless link (not shown). A sensor 31 senses the passing of a runner at the end of a race. It is also contemplated that a separate sensor can be provided for each lane in order to record the time of each participant.

Figure 3:
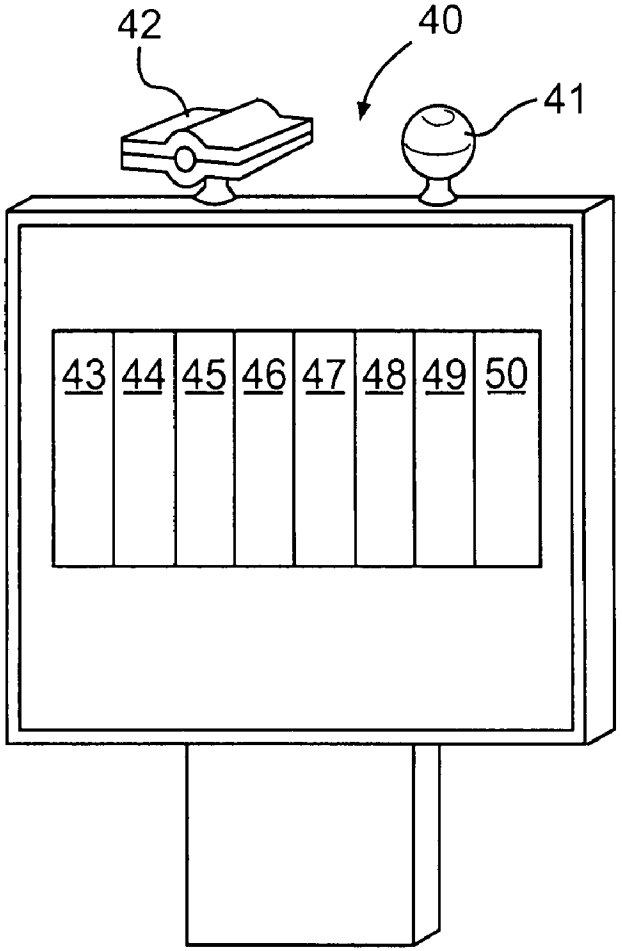
FIG. 3 is a schematic illustration of a scoreboard for use in a starting gate and timing device according to the present invention.

The electronic screen 40 or scoreboard is shown in more detail in FIG. 3. As shown therein the screen 40 has a camera 42 for photographing the finish of a race, a receiver for receiving a photograph of the start of the race and the time of the start. The time of the start of the race may also be provided by the computer set 20. The screen 40 also includes a visual display 43-50, one for each lane in the event. For example, the time of a runner in lane 1 would be displayed in visual display 43. Other conventional forms of display as for example the first, second and third place runners and their times could be readily displayed by programming the computer set 20 to provide the runners number based on the lane in which a specific participant was running. A receiver 41 is adapted to receive a signal indicating the start of an event.

Figure 4:
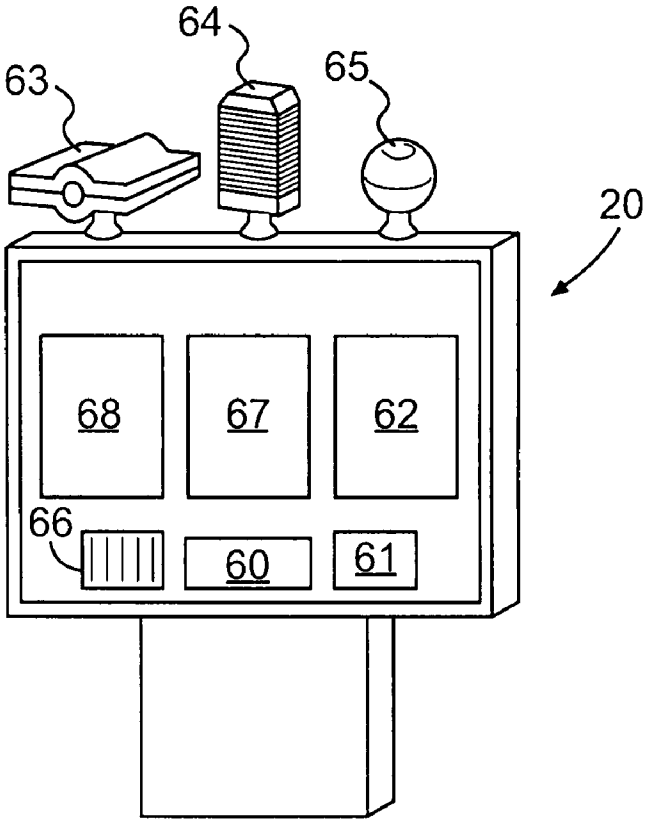
FIG. 4 is a schematic illustration of a control system for use in the practice of the present invention.

The computer set 20 or control station is illustrated in FIG. 4. As shown therein, the computer set 20 or control station includes a computer 60, a start button 61 and master timer or clock 62. An event such as a 100-yard dash is started by pressing the button 61. That action sends an audio signal to the participants by means of the audio speaker 16. The computer controlled audio commands have a controlled cadence and warns the runners by a series of commands such as "on your mark", "get set", followed by the sound of a gun shot. At that instant, the barriers 14 are raised up and the timer or clock 62 is started. The computer set may also activate a camera 63 to record the start of a race. This camera 63 could also be connected to a large screen to allow an audience to more clearly follow an event.

A microphone 64 is also shown in FIG. 4. The microphone 64 is connected to an amplifier and speakers (not shown) in a conventional manner and is used to announce the event as well as notifying the contestants that it is time to report to the starting line. A receiver 65 may also be included for a wireless link to the starting gate 2 and scoreboard 40. In addition, a second receiver 66 may be provided for the remote start of a race as for example during practice starts or the like. In addition, the computer set 20 or control station may also include a computer program for sending a signal to lift the barriers shown schematically by square 67 and recording 68 for issuing the command to start an event. By means of a computer programs, the start of an event could be delayed for different lanes in order to provide a handicapping system.

Figure 5:
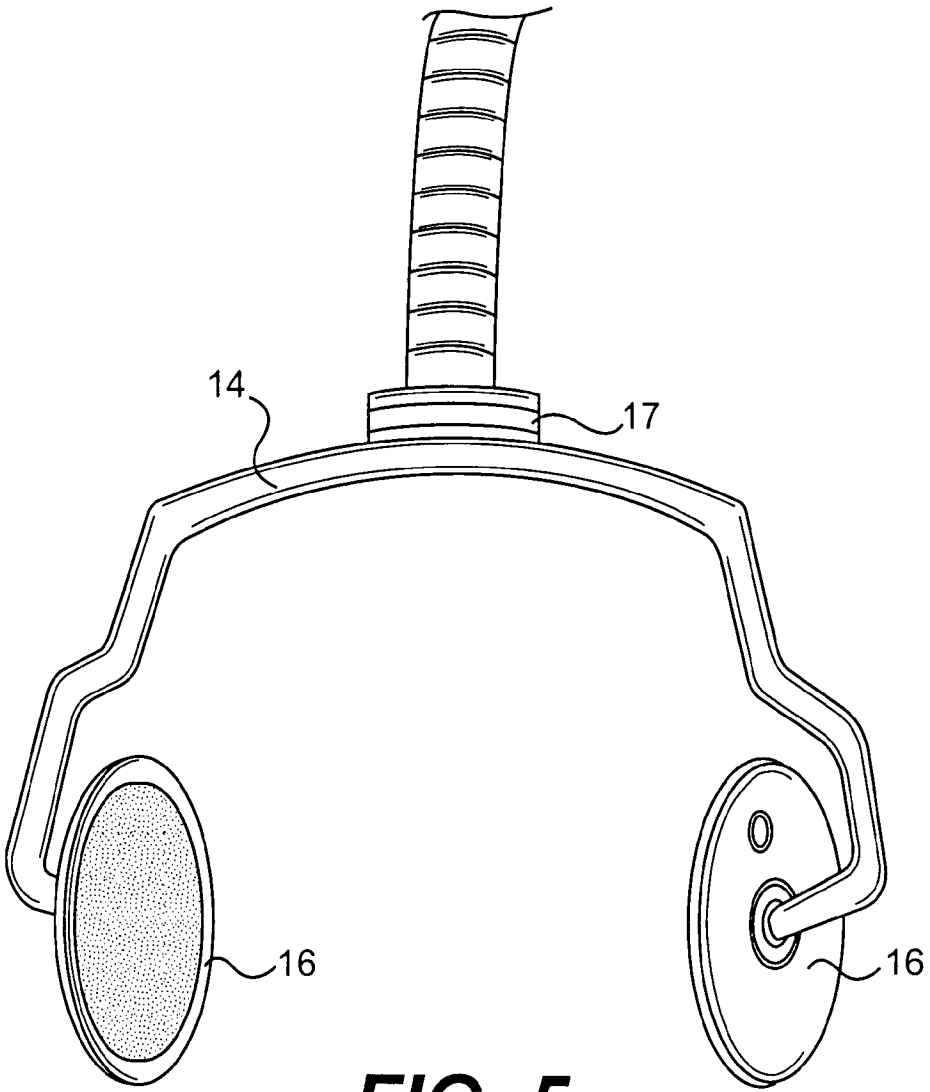
FIG. 5 is a schematic illustration of a barrier and speaker assembly for use in the practice of the present invention.

FIG. 5 shows the barrier portion 14 of the restraint 10 and a pair of speakers 16 which are preferably disposed rearwardly from the barrier portion 14 and adjacent to an athlete's ears. A volume control 15 may also be provided to allow each athlete to adjust the volume to his own selection. In addition, an adjustment mechanism 17 may be provided to raise or lower the barrier 14 to compensate for different heights of different athletes.

Figure 6:
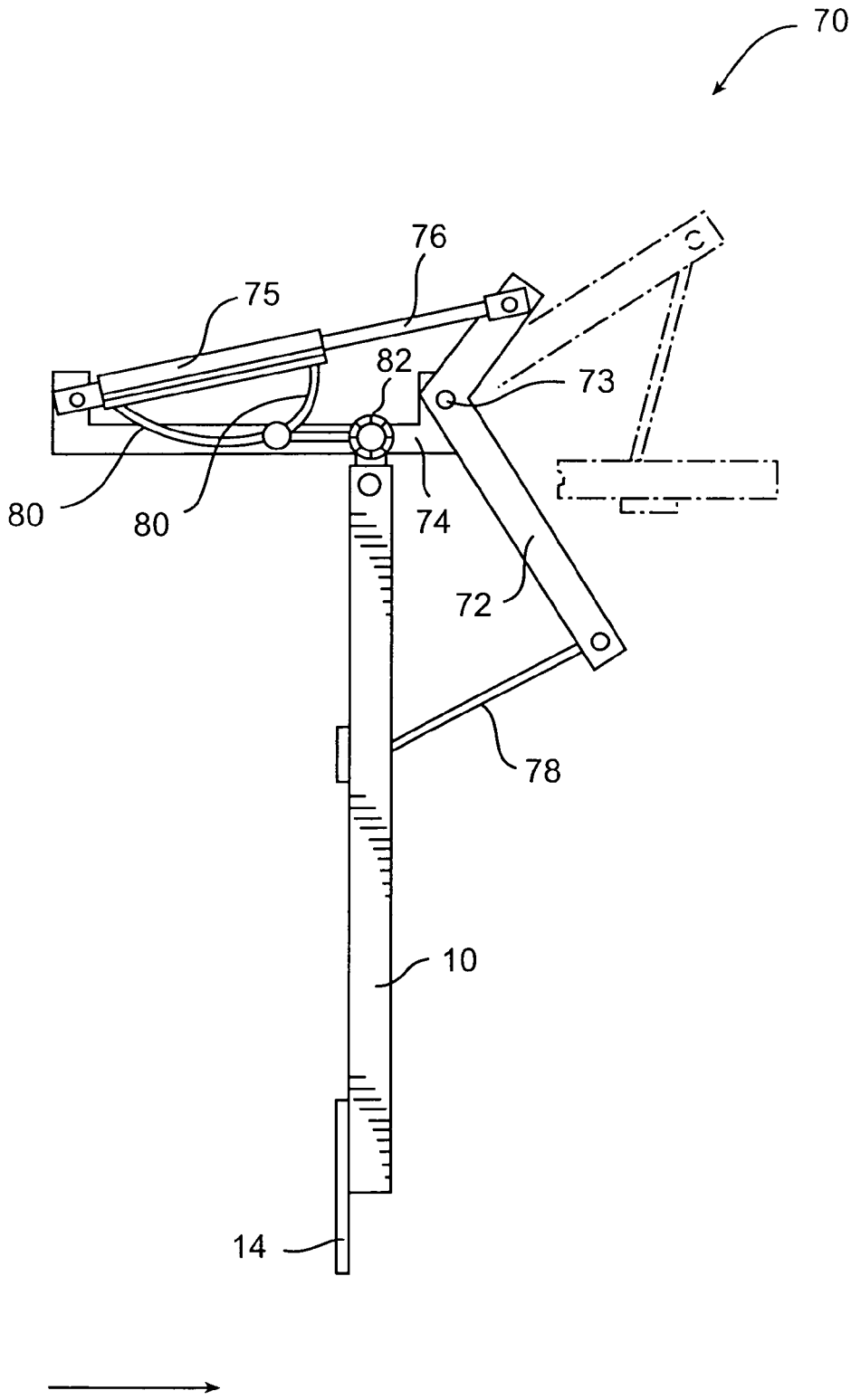
FIG. 6 is a diagrammatic illustration of a mechanism for moving the starting gate at the start of a race.

Referring now to FIG. 6, a mechanism 70 for raising the barrier 14 is illustrated. The mechanism 70 may take any number of forms and is of a conventional design. As shown the mechanism 70 moves the levered restraint 10 including barrier portion 14 upwardly in an arc about the horizontal support member 6 (FIG. 1). The horizontal member may be tubular and may be connected to a source of pressurized air. A crank arm 72 is pivotally connected at 73 on a frame 74 and incorporates a double acting solenoid actuated cylinder 75 having a piston rod 76 for moving the crank arm 72 to a raised portion as shown by dotted lines. A cable and rod 78 couples the crank arm 72 to the levered restraint 10 to raise the restraint a sufficient distance to be clear of an athlete's head. Hoses 80 connect the cylinder 75 with a valve 82 to deliver air to opposite ends of the cylinder 75.

While the invention has been disclosed in connection with this preferred embodiment, it should be recognized that changes and modifications may be made therein without departing from the scope of the appended claims.

What is claimed is:

1. A starting gate for preventing false starts during an athletic event said starting gate comprising a plurality of levered restraints, a plurality of audio speakers with one of said speakers disposed on each of said restraints, means for positioning one of said restraints in front of each of a plurality of athletes with said audio speaker adjacent to an ear of an athlete and means for moving each of said restraints including one of said speakers out of the way of the athlete at the start of an athletic event and wherein said means for moving said restraint out of the way of an athlete simultaneously moves each of said restraints including said speakers out of the way of the athletes at the start of an event and which includes means for adjusting the volume on each of said speakers and which includes adjustment means for adjusting the height of the levered restraints with respect to the head of an athlete.

2. A starting gate for preventing false starts during an athletic event, said starting gate comprising a horizontal bar and two vertical supports positioning said horizontal bar above and across a starting area for an athletic event, a plurality of levered restraints each of which includes a first fixed portion fixed to and rotatable about said horizontal bar and a second barrier portion for positioning in front of an athlete, first adjustment means for positioning said second barrier portion adjacent to an athlete's head, a plurality of audio speakers with one of said audio speakers disposed on each of said barrier portions and means for moving each of said barrier portions simultaneously out of the way of the athlete at the start of an athletic event.

3. A starting gate and timing device for use at an athletic event, said starting gate comprising a horizontal bar and two vertical supports positioning said horizontal bar above and across a starting area for an athletic event, a plurality of levered restraints each of which includes a fixed portion fixed to and rotatable about said horizontal bar and a barrier portion for positioning in front of an athlete, first adjustment means for positioning said barrier portion adjacent to an athlete's head, a plurality of audio speakers with one of said speakers disposed on each of said barrier portions, and means for moving each of said barrier portions out of the way of the athlete at the start of an event, a timer and means for starting said timer operatively connected to said means for moving each of said barrier portions out of the way of the athlete, and sensor means disposed at an area displaced from the starting area operably connected to said timer for sensing a passing athlete and stopping said timer to record the time of the event.

4. The starting gate and timing device for use at an athletic event in accordance with claim 3, in which said means for moving each of said barrier portions out of the way of the athlete move simultaneously.

5. A starting gate and timing device for use at an athletic event in accordance with claim 3, which includes handicapping means for moving each of said barrier portions out of the way of athletes at different time intervals.

6. A starting gate and timing device for use at an athletic event in accordance with claim 3, which includes a computer for starting an athletic event by using an audio command and for immediately moving said linear portion from in front of an athlete.

7. A starting gate and timing device for use at an athletic event in accordance with claim 6, which includes a scoreboard operably connected to said starting gate for displaying the time of the event.

8. A starting gate and timing device for use at an athletic event in accordance with claim 7, in which a plurality of lanes are provided with one lane for each athlete and wherein said sensor means includes a separate sensor for each lane of an athletic event and in which said scoreboard displays the time for each athlete at the end of the event.

* * * * *